US008464679B2

(12) United States Patent
Permuy et al.

(10) Patent No.: US 8,464,679 B2
(45) Date of Patent: Jun. 18, 2013

(54) CORONA TIP INSULATOR

(75) Inventors: Alfred Permuy, Rueil-Malmaison (FR); Keith Hampton, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 523 days.

(21) Appl. No.: 12/773,608

(22) Filed: May 4, 2010

(65) Prior Publication Data

US 2010/0282197 A1 Nov. 11, 2010

Related U.S. Application Data

(60) Provisional application No. 61/175,111, filed on May 4, 2009.

(51) Int. Cl.
*H01T 13/34* (2006.01)
*F02P 23/00* (2006.01)

(52) U.S. Cl.
USPC ..... 123/143 B; 313/128; 313/130; 313/141; 445/7

(58) Field of Classification Search
USPC ..... 123/143 B; 313/128, 130, 141; 445/7
See application file for complete search history.

(56) References Cited

U.S. PATENT DOCUMENTS

| | | | | |
|---|---|---|---|---|
| 2,733,369 | A | 1/1956 | Smits | |
| 3,014,151 | A | 12/1961 | Segall | |
| 4,284,054 | A | 8/1981 | Kumagai et al. | |
| 4,910,428 | A | 3/1990 | Strumbos | |
| 5,469,013 | A * | 11/1995 | Kang | 313/138 |
| 5,731,654 | A | 3/1998 | Benedikt et al. | |
| 5,821,676 | A | 10/1998 | Atchinson, II et al. | |
| 6,274,971 | B1 | 8/2001 | Sugimoto | |
| 6,883,507 | B2 | 4/2005 | Freen | |
| 7,477,008 | B2 | 1/2009 | Artmann et al. | |
| 7,644,698 | B2 * | 1/2010 | Shiraishi et al. | 123/406.19 |
| 2009/0031988 | A1 * | 2/2009 | Shiraishi et al. | 123/406.19 |
| 2012/0112620 | A1 * | 5/2012 | Lykowski et al. | 313/141 |

FOREIGN PATENT DOCUMENTS

| | | | |
|---|---|---|---|
| EP | 0913897 | A1 * | 5/1999 |
| FR | 2859831 | A1 | 9/2012 |
| JP | 2008-166252 | A | 7/2008 |
| KR | 200193476 | Y1 | 8/2000 |
| KR | 100292019 | B1 | 9/2001 |

OTHER PUBLICATIONS

Buchanan, Relva, C. (Eds.). (2004). Ceramic Materials for Electronics, CRC Press.

* cited by examiner

*Primary Examiner* — Erick Solis
(74) *Attorney, Agent, or Firm* — Robert L. Stearns; Dickinson Wright, PLLC

(57) ABSTRACT

This invention relates to a corona discharge ignitor used to ignite air/fuel mixtures in automotive applications and the like. To suppress an arc from forming when a voltage is applied to the ignitor, the corona discharge ignitor has various shapes and configurations, such as angular depressions or grooves, at the tip of the insulator. The shape and configuration of the tip provides a smaller radius which creates a more intensified electric field and provides better combustion.

17 Claims, 5 Drawing Sheets

CORONA TIP INSULATOR

CLAIM FOR PRIORITY

This application claims the benefit of priority to U.S. provisional application 61/175,111, filed May 4, 2009, the contents of which are hereby incorporated by reference.

TECHNICAL FIELD

This invention relates generally to a corona discharge ignitor used to ignite air/fuel mixtures in automotive applications and the like, and in particular to a corona discharge ignitor having angular depressions or grooves at the tip of the insulator.

RELATED ART

Conventional spark plugs generally utilize a ceramic insulator which is partially disposed within a metal shell and extends axially toward a terminal end. A conductive terminal is disposed within a central bore at the terminal end, where the conductive terminal is part of a center electrode assembly disposed within the central bore. At the opposite/corona forming end, the center electrode is disposed within the insulator and has an exposed sparking surface which together with a ground electrode disposed on the shell defines a spark gap. Many different insulator configurations are used to accommodate a wide variety of terminal, shell and electrode configurations.

U.S. Pat. No. 6,883,507 discloses an ignitor for use in a corona discharge air/fuel ignition system. In a typical internal combustion engine, a spark plug socket permits a spark plug to be attached to the engine so that the electrodes of the spark plug communicate with the combustion chamber. As depicted in FIG. 1, a feed-through insulator 71*a* surrounds an electrode 40 as it passes through a cylinder head 51 into the combustion chamber 50. The insulator 71*a* is fixed in an electrode housing 72 which may be a metal cylinder. A space 73 between the electrode housing 72 and the electrode 40 may be filled with a dielectric gas or compressed air. Control electronics and primary coil unit 60, secondary coil unit 70, electrode housing 72, electrode 40 and feed-through insulator 71*a* together form an ignitor 88 which may be inserted into space 52. Ignitor 88 can be threaded into the cylinder head 51 during operation.

In one embodiment, the electrode 40 is placed directly in the fuel-air mixture in the combustion chamber 50, i.e. the electrode extends through the feed-through insulator 71*a* and is directly exposed to the fuel-air-mixture. In another embodiment, the electrode 40 does not extend out of the surrounding dielectric material of the feed-through insulator to be directly exposed to the fuel-air mixture. Rather, the electrode 40 remains shrouded by the feed-through insulator and depends upon the electric field of the electrode passing through part of the feed-through insulator to produce the electric field in the combustion chamber 50.

In the ignitor, the feed-through insulator is fabricated of boron nitride, BN. While BN has excellent dielectric breakdown strength and very low dielectric constant, both of which are highly desirable properties for the application, it is a very soft material, which makes it insufficiently durable to be practical for use in automotive and industrial engines. It is also a very expensive material and is difficult to process into insulators of the desired geometry in an efficient manner for high volume manufacturing.

The publication "Ceramic Materials for Electronics, Third Edition, Revised and Expanded" to Relva C. Buchanan discloses ceramic insulators that serve to insulate electrical circuits and to provide physical separation between conductors and to regulate or prevent current flow between them. The main advantage of ceramics as insulators is their capability for high-temperature operation without hazardous degradation in chemical, mechanical, or dielectric properties. In particular, the class of materials in the publication are known as linear dielectrics, in which the electric displacement (D) increase in direct proportion to the electric field (E), where the proportionality constant is the relative permittivity ($\in_r$), a relative permittivity of material, and the relative permittivity ($\in_o$), a relative permittivity of vacuum. This is expressed as: $D=\in_o\in_r E$, where D=electrical displacement (V/m), E=electric field (V/m), $\in_o$=Relative permittivity of vacuum, and $\in_r$=Relative permittivity of material.

SUMMARY OF THE INVENTION

In general terms, this invention provides a corona discharge ignitor used to ignite air/fuel mixtures in automotive application and the like, and in particular to a corona discharge ignitor having angular depressions or grooves at the tip of the insulator.

The invention includes a closed end ceramic insulator. At the end of the insulator, angular depressions or grooves are oriented perpendicular to one another. As a result of the angular depressions or grooves, there is an increase in the electric field intensity in the surrounding region.

In one embodiment of the invention, there is an ignitor of a corona discharge fuel/air ignition system including a ceramic insulator having a terminal end and a corona forming end, the corona forming end of the ceramic insulator formed to increase an electric field intensity in a region of the corona forming end.

In another embodiment of the invention, there is an internal combustion engine include a cylinder head with an ignitor opening extending from an upper surface to a combustion chamber having a radially extending upper shoulder between said upper surface and said combustion chamber, and a corona ignitor, the ignitor including a ceramic insulator having a terminal end and a corona forming end, the corona forming end of the ceramic insulator formed to increase an electric field intensity in a region of the corona forming end.

In still another embodiment of the invention, there is a method of forming an ignitor of a corona discharge fuel/air ignition system, including providing the corona ignitor with a ceramic insulator surrounded at least partially by a shell; and forming a corona forming end of the ignitor to increase an electric field intensity in a region of the corona forming end.

In one aspect of the invention, the ceramic insulator is closed at the corona forming end.

In another aspect of the invention, the corona forming end of the ceramic insulator is formed as one of the following: a pair of angular depression or grooves oriented perpendicular to one another; a flat, circular top; a single angular depression or groove in a V-shape; a rounded top; a flat, circular top with depressions or grooves forming a star-shape; and a conical shape with a flat, circular top.

In yet another aspect of the invention, the ceramic insulator further includes an inner bore which extends along a longitudinal bore axis from the terminal end to the corona forming end; and an electrode received in the inner bore and surrounded by the ceramic insulator at the corona forming end.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

In a corona ignition system, a radio frequency signal is generated in an electronic circuit and transmitted through a coaxial cable to an ignitor. If the voltage is too high, then an unwanted arc can form from the electrode tip to the head. Typically, prevention of arcing is accomplished using either a circuit to detect and stop the arc, or a mechanical barrier is placed around the electrode. However, the barrier serves to reduce the electric field intensity which is required to achieve ignition. The instant invention serves to provide an electric field intensity which is great enough to achieve ignition, without arcing or the requirement to detect such arcing.

Figure 1:
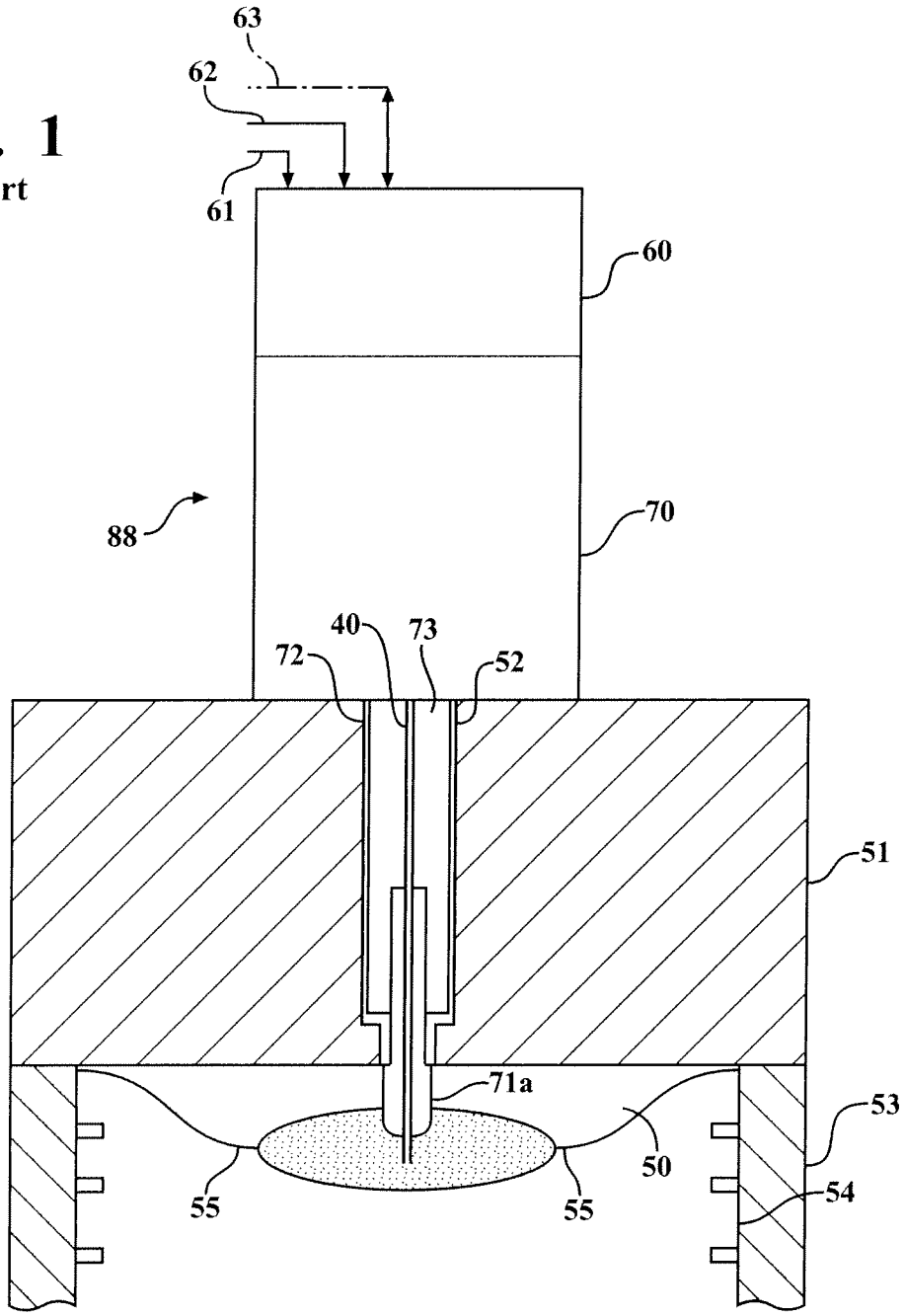
FIG. 1 Prior Art
FIG. 1 shows components of a corona discharge combustion system in an internal combustion engine, as known in the prior art.
Figure 2:
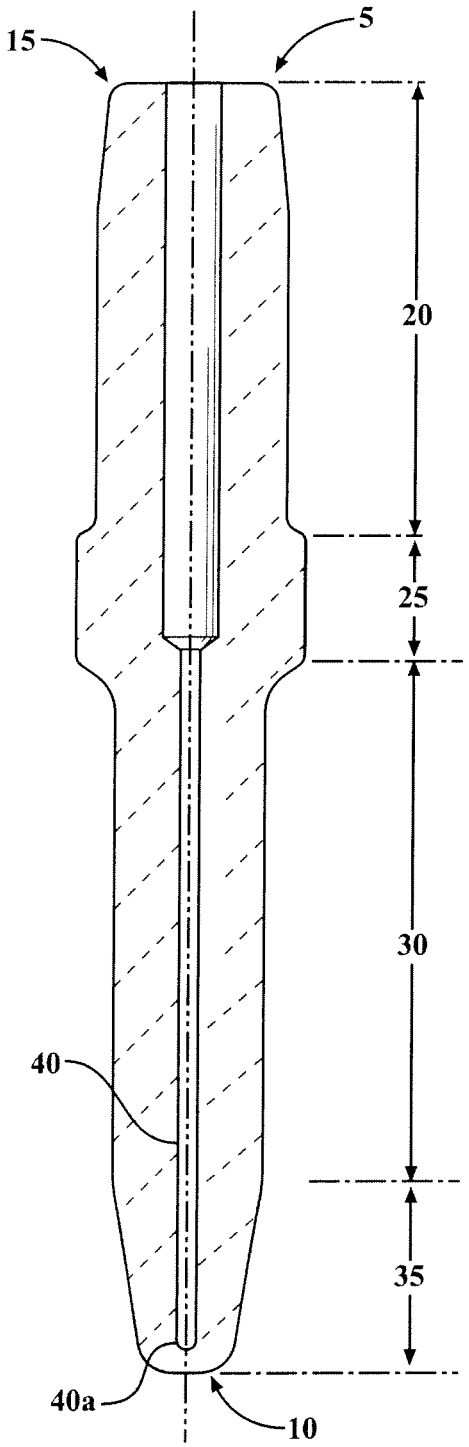
FIG. 2 is an exemplary corona tip insulator in accordance with the invention.

As illustrated in FIG. 2, an insulator 5, typically made of ceramic and non-conducting, extends between a corona forming end 10 and a terminal end 15. From the terminal end 15 and extending toward the corona forming end 10, the corona forming end assembly insulator 5 includes a terminal portion 20, a large shoulder 25, a small shoulder 30, and a corona forming end portion 35. At the corona formingend 10, the insulator may be formed into various shapes, configurations and embodiments, as described in detail below. While the ceramic insulator illustrated in the figures and described herein has features similar to those found in a typical spark plug used in an internal combustion engine, such as for use in an automobile engine, one skilled in the art would readily recognize that the insulator may be formed in a variety of shapes, sizes, and configurations depending on the desired application. For example, in some embodiments, the shoulders 25 may be missing.

An electrode 40 is received within the insulator 5 and forms an electrode tip 40*a* at the corona forming end 10. The electrode tip 40*a* also resides inside the insulator 5, which insulator has particles of metal embedded therein. The electric field that the electrode tip 40*a* creates an electric field around the metal particles of the insulator. The induced electric field creates a non-thermal plasma in the gas which causes a corona to form. However, if a high density plasma is formed, an arc will not form given the high impedance between the electrode tip and the metal particles.

Figure 3A:
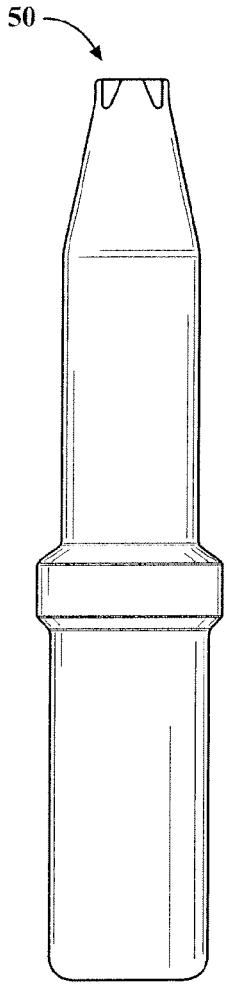
FIG. 3A is an exemplary corona tip insulator with angular depressions in accordance with the invention.
Figure 3B:
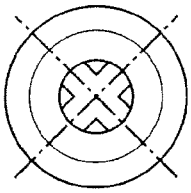
FIG. 3B is an exemplary top view of a corona tip of the insulator illustrated in FIG. 3A.
Figure 4B:
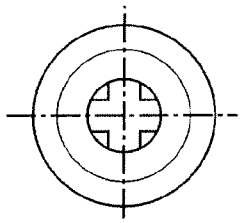
FIG. 4B is an exemplary top view of the corona tip insulator of FIG. 4A.

FIG. 3A is an exemplary corona tip insulator, similar to FIG. 2, in accordance with the invention. In the illustrated embodiment, a closed ended ceramic insulator has angular depressions or grooves 50 formed into the corona forming end thereof. Here, a pair of angular depressions, oriented perpendicular to each other, are formed at the corona forming end of the insulator. This arrangement forms the end of the insulator into four "horns" that serve to increase the electric field intensity in their region. This increase in electric field intensity eliminates the need for a circuit to detect arcing, while at the same time providing a well defined and intense corona. It is understood that the angular depressions and grooves may be formed by machining or any manner recognized by the skilled artisan. FIG. 3B is an exemplary top view of the corona tip of the insulator illustrated in FIG. 3A.

Figure 4A:
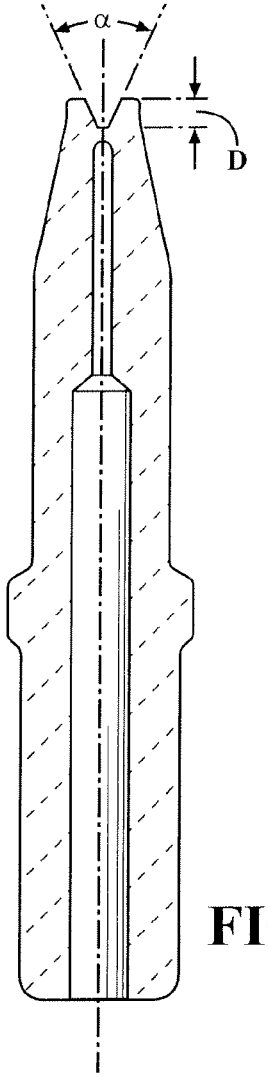
FIG. 4A is an exemplary cross-section of the corona tip insulator of FIG. 3A in accordance with the invention.
Figures 5A, 5B, 5C, 5D, 5E, 5F:
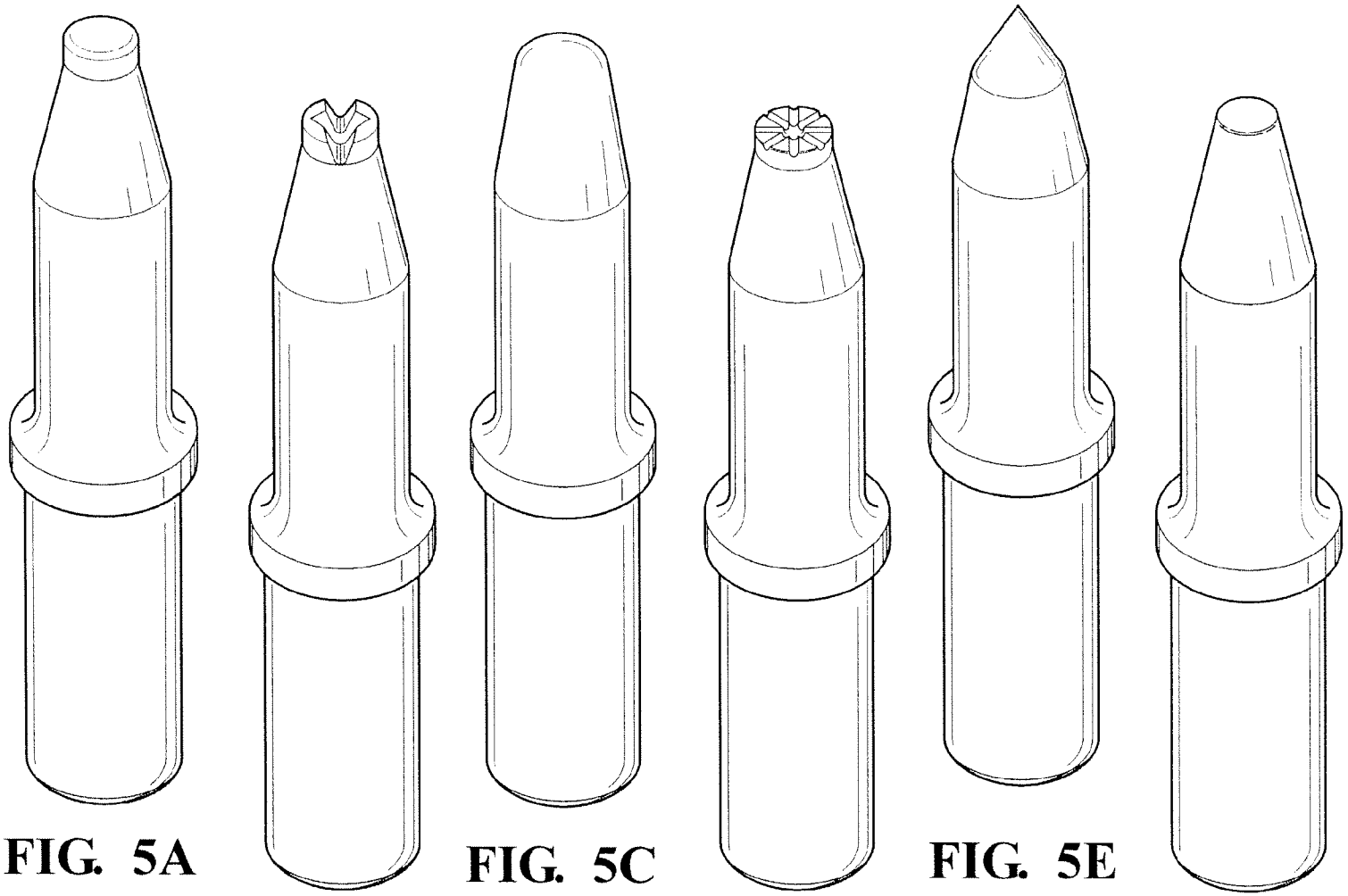
FIGS. 5A-5F are exemplary embodiments of the invention with various embodiments of the angular depressions or grooves, and various embodiments in which the closed end tip extends outward in a variety of shapes.
Figures 6A, 6B, 6C, 6D, 6E, 6F:
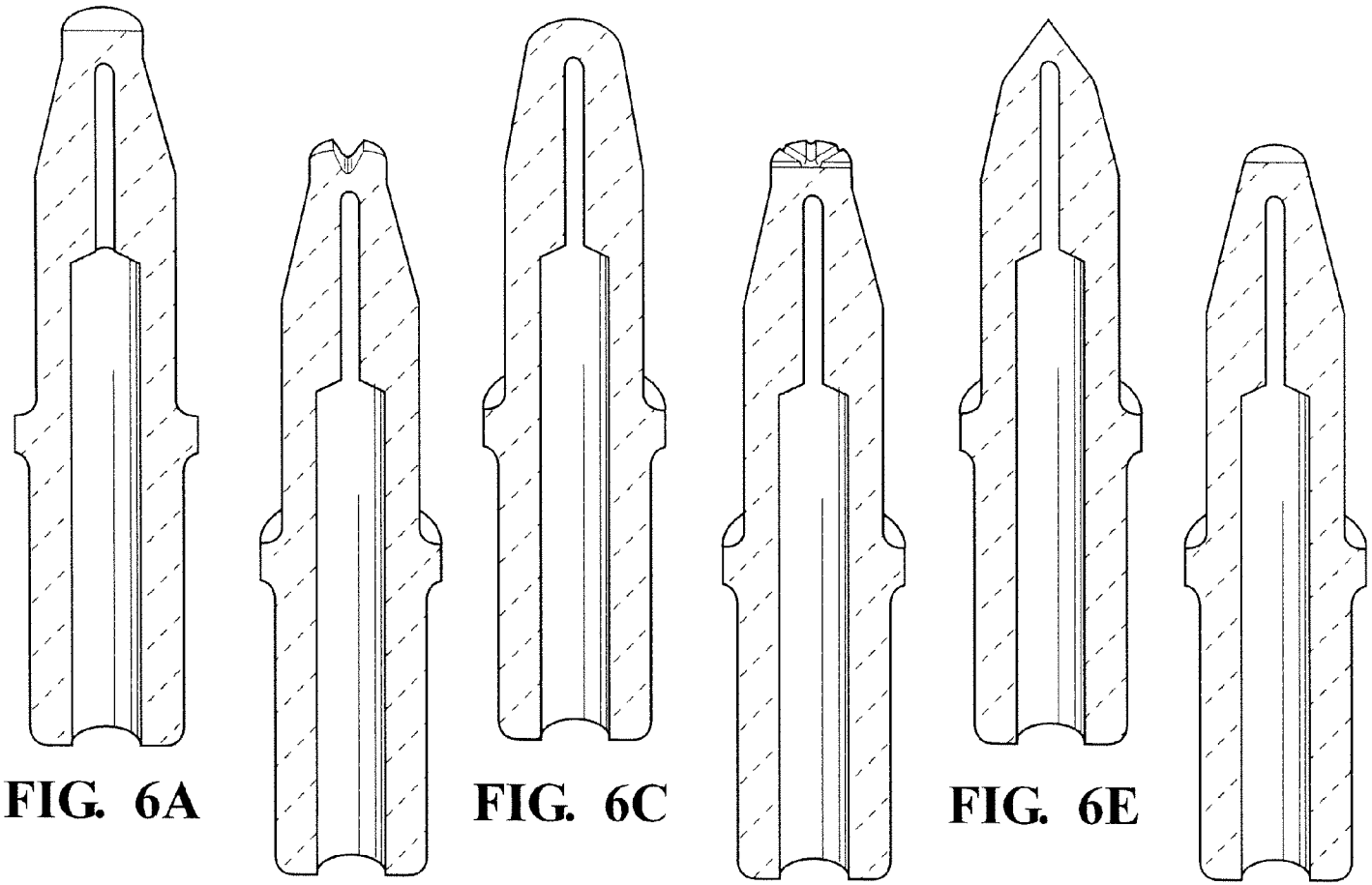
FIGS. 6A-6F show a cross-sectional view of the embodiments in FIGS. 5A-5F.

FIG. 4A is an exemplary cross-section of the corona tip insulator of FIG. 3A in accordance with the invention. As explained above, the insulator material has a cavity in which an electrode is received. At the corona forming end of the insulator, the tip is formed into angular depressions or grooves 50. The angular depressions or grooves 50 are formed with an angle $\alpha$ and a depth d. The angle $\alpha$ and depth d may be varied to accommodate various operating conditions and demands of a particular engine. Similarly, the shape, size and configuration of the insulator tip may be formed to create various embodiments, as illustrated for example in FIGS. 5A-5F. FIG. 5A shows an embodiment where the insulator tip is formed as a flat, circular top. FIG. 5B shows an embodiment where the insulator tip is formed with a single angular depression or groove in a V-shape. FIG. 5C shows an embodiment where the insulator tip is formed as a rounded top. FIG. 5D shows an embodiment where the insulator tip is formed as a flat, circular top similar to FIG. 5A, where the top has depressions or grooves formed therein. In the embodiment disclosed, the depressions or grooves form a star-shape. FIG. 5E shows an embodiment where the insulator tip is formed in an conical shape, which tip ends in a point. FIG. 5F shows an embodiment where the insulator tip is formed as an conical shape similar to FIG. 5E, where the tip of the insulator ends in a flat, circular top. FIGS. 6A-6F show a cross-sectional view of the embodiments in FIGS. 5A-5F, respectively.

The invention operates, for example, in the following manner. The ceramic insulator 5 has a metal conductor (electrode) 40 that runs down the center, as illustrated in FIG. 2. A voltage is applied to the electrode 40, where the voltage is typically applied in a sinusoidal fashion. Since the insulator 5 is ceramic, it is electrically resistive in nature, thereby providing a permittivity that is able to hold a charge. The resistance to the voltage prevents current from flowing, until a breakdown voltage level is reached. The applied voltage allows a corona to form. Once the breakdown voltage level is reached, the current will flow there-through and an arc will be formed at the corona forming end 10 of the insulator 5.

As understood in the art, prior to breakdown occurring, an electric field is formed around the electrode 40. The electric field surrounds the ceramic insulator 5 and changes in voltage level similar to the electrode itself. A corona is therefore formed on the ceramic such that the electrode does not need to extend into the combustion chamber. That is, the electrode 40 is electrically insulated from the combustion chamber and uses the insulator (ceramic) to form the corona. Significantly, in the embodiment of FIGS. 3A-3B and 4A-4B, the angular depressions or grooves form "points" or "horns" that create a small radius on the insulator near its tip. The smaller radius creates a more intensified electric field, which provides better ionization. Additionally, as illustrated in FIGS. 5A-F and 6A-6F and similar to the embodiment in FIGS. 3A-3B and 4A-4B, the tip may be shaped in a variety of angles, depressions and grooves to form a tip that provides a corona with an intensified electric field by creating a smaller radius on the insulator near its tip. It is appreciated that this invention is not limited to the illustrated embodiments, and may comprise any shape or configuration capable of achieving corona.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. An ignitor of a corona discharge fuel/air ignition system comprising:

a ceramic insulator having a terminal end and a corona forming end presenting an outer surface, an electrode received in the ceramic insulator, the electrode presenting a firing tip, the corona forming end of the ceramic insulator surrounding the firing tip of the electrode, and the outer surface of the corona forming end including at least one depression.

2. The ignitor of claim 1, wherein the ceramic insulator is closed at the corona forming end.

3. The ignitor of claim 1, wherein the outer surface of the corona forming end of the ceramic insulator includes at least one of the following:

a flat, circular surface surrounding the at least one depression;

a rounded surface surrounding the at least one depression;

and a conical shape with a flat, circular surface surrounding the at least one depression.

4. The ignitor of claim 1, wherein the ceramic insulator further comprises an inner bore which extends along a longitudinal bore axis from the terminal end to the corona forming end; and the electrode is received in the inner bore and surrounded by the ceramic insulator at the corona forming end.

5. A corona ignition system of an internal combustion engine including a cylinder head with an ignitor opening extending from an upper surface to a combustion chamber, and a corona ignitor disposed in the ignitor opening, the corona ignitor comprising a ceramic insulator having a terminal end and a corona forming end presenting an outer surface, an electrode received in the ceramic insulator, the electrode presenting a firing tip, the corona forming end of the ceramic insulator surrounding the firing tip of the electrode, and the outer surface of the corona forming end including at least one depression.

6. The corona ignition system of claim 5, wherein the ceramic insulator is closed at the corona forming end.

7. The corona ignition system of claim 5, wherein the outer surface of the corona forming end of the ceramic insulator includes at least one of the following:

a flat, circular surface surrounding the at least one depression;

a rounded surface surrounding the at least one depression;

and a conical shape with a flat, circular surface surrounding the at least one depression.

8. The corona ignition system of claim 5, wherein the ceramic insulator further comprises an inner bore which extends along a longitudinal bore axis from the terminal end to the corona forming end; and the electrode is received in the inner bore and surrounded by the ceramic insulator at the corona forming end.

9. A method of forming an ignitor of a corona discharge fuel/air ignition system, comprising:

providing an electrode including a firing tip;

surrounding the firing tip of the electrode with a corona forming end of a ceramic insulator; and forming at least one depression in an outer surface of the corona forming end of the ceramic insulator.

10. The method of claim 9, wherein the ceramic insulator is closed at the corona forming end.

11. The method of claim 9, wherein the outer surface of the corona forming end of the ceramic insulator includes at least one of the following:

a flat, circular surface surrounding the at least one depression;

a rounded surface surrounding the at least one depression;

and a conical shape with a flat, circular surface surrounding the at least one depression.

12. The method of claim 9, further comprising the step of providing an inner bore in the ceramic insulator which extends along a longitudinal bore axis from a terminal end to the corona forming end; and wherein the step of surrounding the firing tip of the electrode includes receiving the electrode in the inner bore of the ceramic insulator.

13. An ignitor of a corona discharge fuel/air ignition system comprising:

a ceramic insulator having a terminal end and a corona forming end presenting an outer surface, an electrode received in the ceramic insulator, the electrode presenting a firing tip, the corona forming end of the ceramic insulator enclosing the firing tip of the electrode, and the outer surface of the corona forming end being flat.

14. An ignitor of a corona discharge fuel/air ignition system comprising:

a ceramic insulator having a terminal end and a corona forming end presenting an outer surface, an electrode received in the ceramic insulator, the electrode presenting a firing tip, the corona forming end of the ceramic insulator enclosing the firing tip of the electrode, and the outer surface of the corona forming end being conical.

15. The ignitor of claim 1, wherein the at least one depression includes a pair of depressions being angular and oriented perpendicular to one another.

16. The ignitor of claim 1, wherein the at least one depression forms a V-shape.

17. The ignitor of claim 1, wherein the at least one depression includes a plurality of depressions forming a star shape.

* * * * *